US009001161B2

(12) United States Patent
Atkins et al.

(10) Patent No.: US 9,001,161 B2
(45) Date of Patent: Apr. 7, 2015

(54) CHROMATICITY CONTROL FOR SOLID-STATE ILLUMINATION SOURCES

(75) Inventors: Robin Atkins, Vancouver (CA); Vincent Kwong, Vancouver (CA); Chun Chi Wan, Richmond (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 525 days.

(21) Appl. No.: 12/436,078

(22) Filed: May 5, 2009

(65) Prior Publication Data

US 2010/0118057 A1 May 13, 2010

Related U.S. Application Data

(60) Provisional application No. 61/059,719, filed on Jun. 6, 2008.

(51) Int. Cl.

| | |
|---|---|
| ***G09G 3/32*** | (2006.01) |
| ***G09G 3/34*** | (2006.01) |
| ***H05B 33/08*** | (2006.01) |

(52) U.S. Cl.

CPC ..... *G09G 3/32* (2013.01); *G09G 3/3413* (2013.01); *H05B 33/0818* (2013.01); *H05B 33/0857* (2013.01); *H05B 33/0869* (2013.01); *G09G 2320/041* (2013.01); *G09G 2320/048* (2013.01); *G09G 2320/064* (2013.01); *G09G 2320/0666* (2013.01); *G09G 2360/145* (2013.01)

(58) Field of Classification Search

CPC ..... G09G 3/32; G09G 3/10; G09G 3/36; H05B 41/36

See application file for complete search history.

(56) References Cited

U.S. PATENT DOCUMENTS

| | | | | |
|---|---|---|---|---|
| 6,411,046 | B1 | 6/2002 | Muthu | |
| 6,608,614 | B1 | 8/2003 | Johnson | |
| 2002/0048169 | A1 | 4/2002 | Dowling et al. | |
| 2002/0048177 | A1 | 4/2002 | Rahm et al. | |
| 2003/0016198 | A1 * | 1/2003 | Nagai et al. | 345/83 |
| 2003/0076056 | A1 | 4/2003 | Schuurmans | |
| 2004/0041778 | A1 * | 3/2004 | Hiraki et al. | 345/100 |
| 2005/0190171 | A1 | 9/2005 | Jang et al. | |
| 2006/0290624 | A1 | 12/2006 | Ashdown | |
| 2007/0034775 | A1 | 2/2007 | Cheng et al. | |
| 2007/0057902 | A1 | 3/2007 | Joung | |
| 2007/0120496 | A1 * | 5/2007 | Shimizu et al. | 315/169.3 |
| 2009/0079357 | A1 * | 3/2009 | Shteynberg et al. | 315/291 |

FOREIGN PATENT DOCUMENTS

| | | | |
|---|---|---|---|
| EP | 1152642 | A2 | 11/2001 |
| WO | 03037042 | A1 | 5/2003 |
| WO | 2006014473 | A1 | 2/2006 |
| WO | 2006130973 | A1 | 12/2006 |
| WO | 2007019663 | A1 | 2/2007 |

* cited by examiner

*Primary Examiner* — Tony N Ngo

(57) ABSTRACT

Chromaticity of light output by a light-emitting diode, such as a light-emitting diode (LED), is adjusted while maintaining a brightness of the illumination source substantially constant by adjusting a drive schema for the illumination source. A driver for LEDs or other light-emitting diodes provides for varying a drive schema to adjust chromaticity of driven LEDs.

26 Claims, 8 Drawing Sheets

CHROMATICITY CONTROL FOR SOLID-STATE ILLUMINATION SOURCES

REFERENCE TO RELATED APPLICATIONS

This application claims the benefit under 35 U.S.C. §119 of U.S. Application No. 61/059,719 filed on Jun. 6, 2008, entitled CHROMATICITY CONTROL FOR SOLID-STATE ILLUMINATION SOURCES, which is incorporated herein by reference.

TECHNICAL FIELD

This invention relates to solid-state illumination sources, such as light emitting diodes (LEDs). The invention has application in apparatus such as computer displays, televisions, projectors, home cinema displays, and other apparatus which apply solid-state illumination sources to generate light.

BACKGROUND

Process variations in the manufacturing of light-emitting diodes and other solid-state illumination sources can cause variations in the spectral composition of emitted light. For example, LEDs may be designed to emit light in a band of wavelengths centered at a specific wavelength. Process variations during manufacturing can cause the individual LEDs to emit light in bands that are shifted from the designed-for wavelengths by various amounts. LED manufacturers typically sort LEDs into "bins". The bins may be defined, for example, based on the chromaticity of the emitted light as well as other factors, such as the intensity of the emitted light. The cost for purchasing LEDs can vary significantly depending upon the bin.

LEDs may be used for illumination in a wide variety of applications. For example, arrays of LEDs may be used as the backlights in computer displays, televisions, and other displays. Arrays of LEDs may also be used as illumination sources in architectural lighting and other fields. In fields where the chromaticity of the light is important, such as in high quality displays, it may be necessary to select LEDs having tightly controlled and/or matched light outputs. This can be expensive.

The foregoing examples of the related art and limitations related thereto are intended to be illustrative and not exclusive. Other limitations of the related art will become apparent to those of skill in the art upon a reading of the specification and a study of the drawings.

SUMMARY

This invention provides methods and apparatus which generate light using solid-state illumination sources and/or control solid-state illumination sources to generate light.

One example aspect of the invention provides apparatus for driving a light-emitting diode. The apparatus comprises a driving circuit configured to control a driving current in the light-emitting diode according to a driving schema and a control value to cause the light-emitting diode to emit light having a brightness determined by the control value. The apparatus includes a control circuit configured to alter the driving schema without changing the brightness.

Another example aspect of the invention provides a display comprising a plurality of light-emitting diodes. The display has a driving circuit configured to control a driving current in each of the light-emitting diodes according to a corresponding driving schema and a corresponding control value to cause the light-emitting diode to emit light having a brightness determined by the control value.

Another example aspect of the invention provides a method for controlling a light-emitting diode. The method comprises controlling a driving current in the light-emitting diode according to a driving schema and a control value to cause the light-emitting diode to emit light having a brightness determined by the control value. The method alters the driving schema while maintaining the brightness substantially unchanged. The alteration in the driving schema may be selected to change a chromaticity of light emitted by the light-emitting diode or to maintain one or more characteristics of the chromaticity of light emitted by the light-emitting diode constant.

Another example aspect of the invention provides a LED driver unit for driving a plurality of LEDs. The driver unit comprises a plurality of driving circuits each having an input for receiving a control value and an output connectable to a LED to be driven. For each of the driving circuits an independently-variable stored driving schema is provided. The driver circuits are each configured to control a driving current in the light-emitting diode according to the corresponding driving schema and the corresponding control value to cause the light-emitting diode to emit light having a brightness determined by the control value and a chromaticity affected by the driving schema.

In addition to the exemplary aspects and embodiments described above, further aspects and embodiments will become apparent by reference to the drawings and by study of the following detailed description.

BRIEF DESCRIPTION OF THE DRAWINGS

The accompanying drawings illustrate non-limiting example embodiments of the invention.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
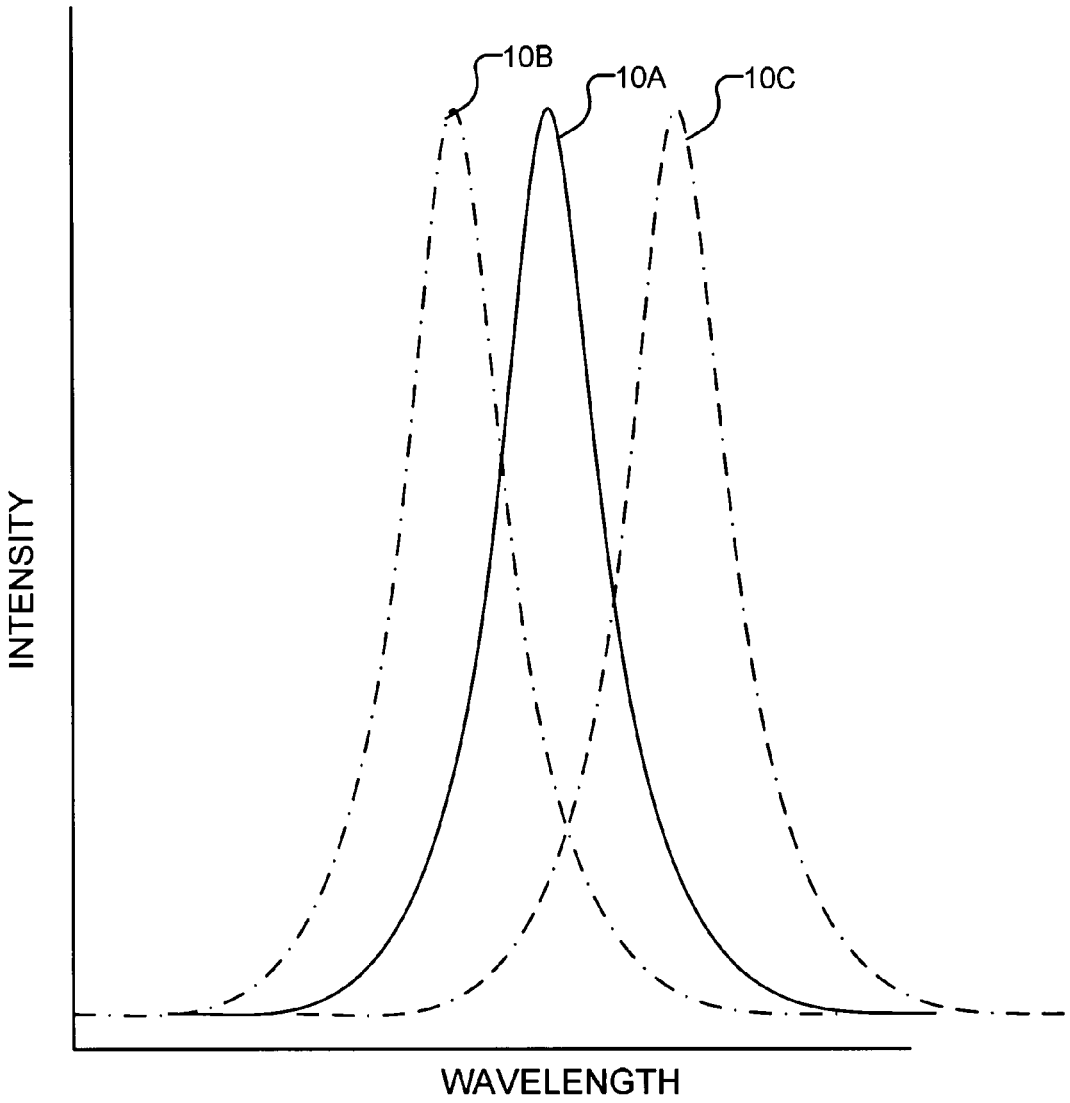
FIG. 1 is a plot showing intensity as a function of wavelength for three different solid-state illumination sources.

FIG. 1 is a plot which includes a curve 10A showing a designed-for variation in intensity as a function of wavelength for a solid-state illumination source, such as a light emitting diode. Curves 10B and 10C illustrate that the spectrum for an actual light emitting diode may be shifted to higher or lower wavelengths from the ideal curve 10A as a result of manufacturing process variations or the like. To address this issue in cases where chromaticity of the emitted light is important, manufacturers have been forced to carefully select light emitting diodes which emit light having a spectral composition close to that of the ideal curve 10A.

Figure 1A:
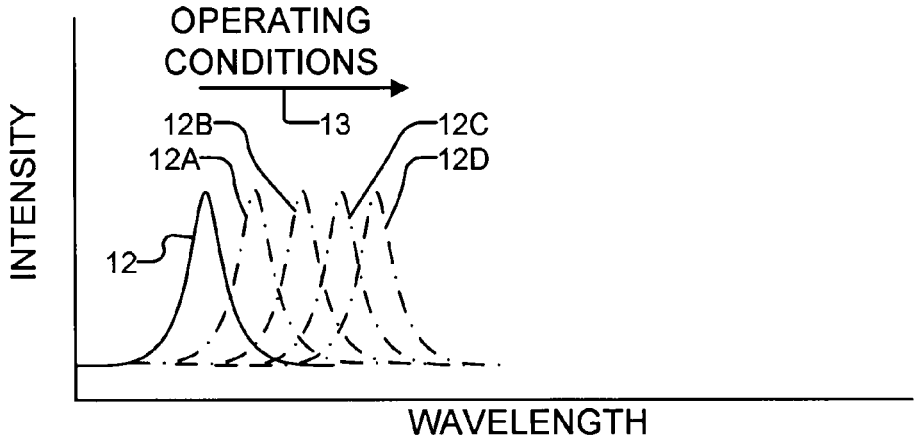
FIG. 1A is a set of plots showing intensity as a function of wavelength for a solid-state illumination source being driven with different driving signals.

As shown in FIG. 1A, the chromaticity of light emitted by a light emitting diode or other solid-state illumination source can be made to vary by changing the operating conditions of the solid-state illumination source. For example, the spectrum of light emitted by a LED can be shifted by varying features of the driving current such as:

- the peak current,
- whether or not the driving current is pulsed, and
- the duty cycle and/or waveform of the driving current if it is pulsed.

In FIG. 1A, arrow 13 indicates a change in operating conditions which cause light emitted by a solid-state illumination source to change in spectrum from the spectrum indicated by curve 12 to the spectrum indicated by 12D (by way of intermediate curves 12A, 12B and 12C).

The fact that the electrical driving signals applied to drive a solid-state illumination source can cause the spectral content of light emitted by the illumination source to change can be used to advantage in a wide range of situations where it is desirable to maintain fine control over the chromacity of emitted light.

Figure 2A:
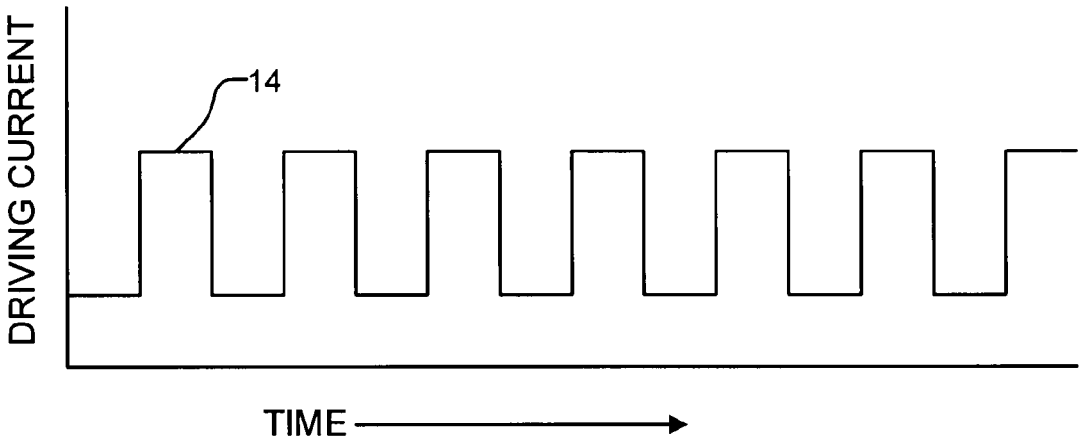
FIGS. 2A, 2B and 2C illustrate three different driving signals that may be applied to cause a solid-state illumination source to emit light.
Figure 2B:
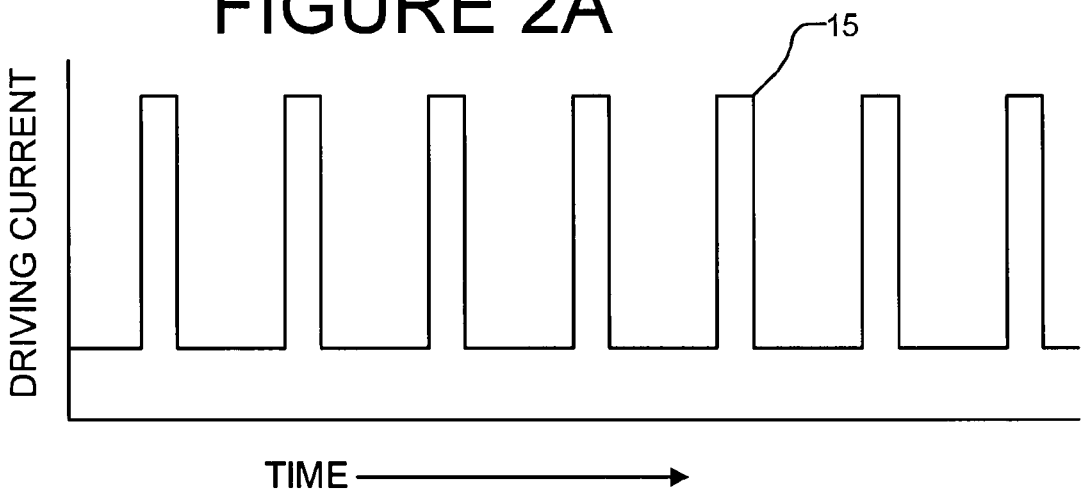
Figure 2C:
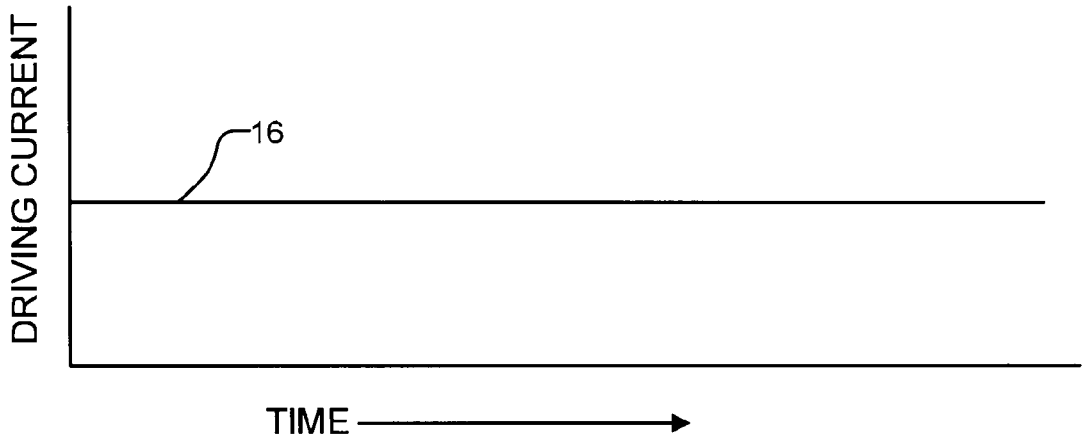

FIGS. 2A, 2B and 2C illustrate driving current as a function of time for three different driving schemes. In FIG. 2A, the driving current is delivered in the form of a square wave 14 having a duty cycle of approximately 50%. In FIG. 2B, the driving current varies according to a signal 15 which comprises spaced-apart pulses. In FIG. 2C, the driving current is represented by a DC value 16. The amplitudes of the waveforms shown in FIGS. 2A, 2B and 2C, may be selected so that the apparent brightness of light emitted by a solid-state illumination source is the same for each waveform but the spectral content of that light is different for each waveform.

Figure 3:
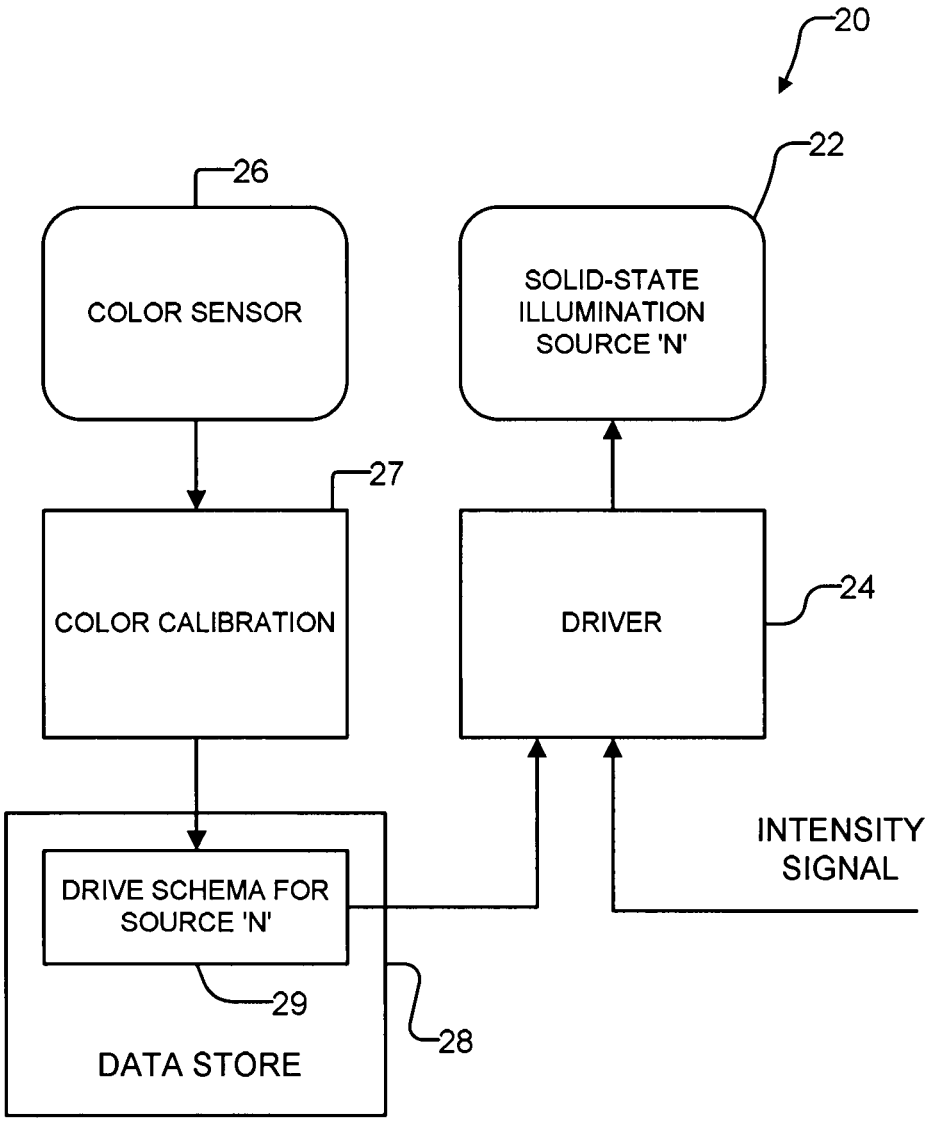
FIG. 3 is a block diagram of apparatus according to an embodiment of the invention which includes a color calibration system for adjusting the chromaticity of light emitted by a solid-state illumination source.

FIG. 3 shows an apparatus 20 which includes a solid-state illumination source 22. Solid-state illumination source 22 comprises a light-emitting diode in some embodiments. Typically, solid-state illumination source 22 comprises a semiconductor junction and light is emitted at the semiconductor junction in response to the flow of electrical current through the junction.

Apparatus 20 may include a large number of solid-state illumination sources of which illumination source 22 is one. A driver 24 supplies driving current to solid-state illumination source 22. The driving current causes illumination source 22 to emit light. As described below, driver 24 is capable of driving solid-state illumination source 22 using a range of different waveforms. By appropriate selection of features of the waveform used to drive solid-state illumination source 22, the chromaticity of light emitted by solid-state illumination source 22 can be varied.

A color sensor 26 detects light emitted by solid-state illumination source 22. Color sensor 26 generates a signal provided to a color calibration unit 27. Color calibration unit 27, based upon the signal, establishes a driving schema to be used to drive solid-state illumination source 22.

Establishing the driving schema may comprise looking up information specifying predetermined driving schema for different values of the signal; computing features of a driving schema based at least in part on the signal; or, iteratively refining a driving schema based on the signal. The driving schema may, for example, specify characteristics of a driving signal to be used to cause the solid-state illumination source to emit light of different brightness. the characteristics may comprise, for example characteristics of the driving signal such as one or more of:

- a relationship between pulse width and maximum driving current;
- a waveform;
- a pulse frequency;
- a pulse width;
- a pulse amplitude;
- a drive mode (e.g. constant-current or pulsed or pulsed with a constant background);
- relationships between these characteristics; and
- the like.

These characteristics or variations in the characteristics may be specified as functions of desired output brightness. The drive schema comprises information that specifies what driving current to apply to a solid-state illumination source in response to a given input to achieve light output having a brightness specified by the input.

Color calibration unit 27 stores a driving schema 29 for solid-state illumination source 22 in a data store 28 accessible to driver 24. After calibration, driver 24 receives intensity signals 25 and generates an appropriate wave form to drive solid-state illumination source 22 based upon the intensity signal as well as driving schema 29.

Apparatus 20 may, for example, be integrated with a LED driver circuit. The LED driver circuit may be configured to drive a plurality of LEDs. A separate driving schema may be stored in data store 28 for each LED, or for each group of LEDs.

One application of apparatus 20 is to permit the use of LEDs or other solid-state illumination sources, having slightly mis-matched spectral characteristics in a backlight or other array. Apparatus 20 can be used to adjust the spectral characteristics of the LEDs in the array to match one another. Even in a case where the driving signals cause all of the LEDs to emit light of the same intensity, the driving signals applied to different LEDs in the array may be different from one another. The different driving signals shift the spectral characteristics of light emitted by the LEDs to, for example, cause all of the LEDs to emit light having a similar spectral composition.

As another example, driving schemas 29 may be selected to cause different LEDs in the array or different groups of LEDs in the array, to emit light having somewhat different spectral compositions. This may be done in a case where it is desired to cause the array to emit light having a broadened spectral distribution. There may be two or more such groups of LEDs in the array.

Figure 4:
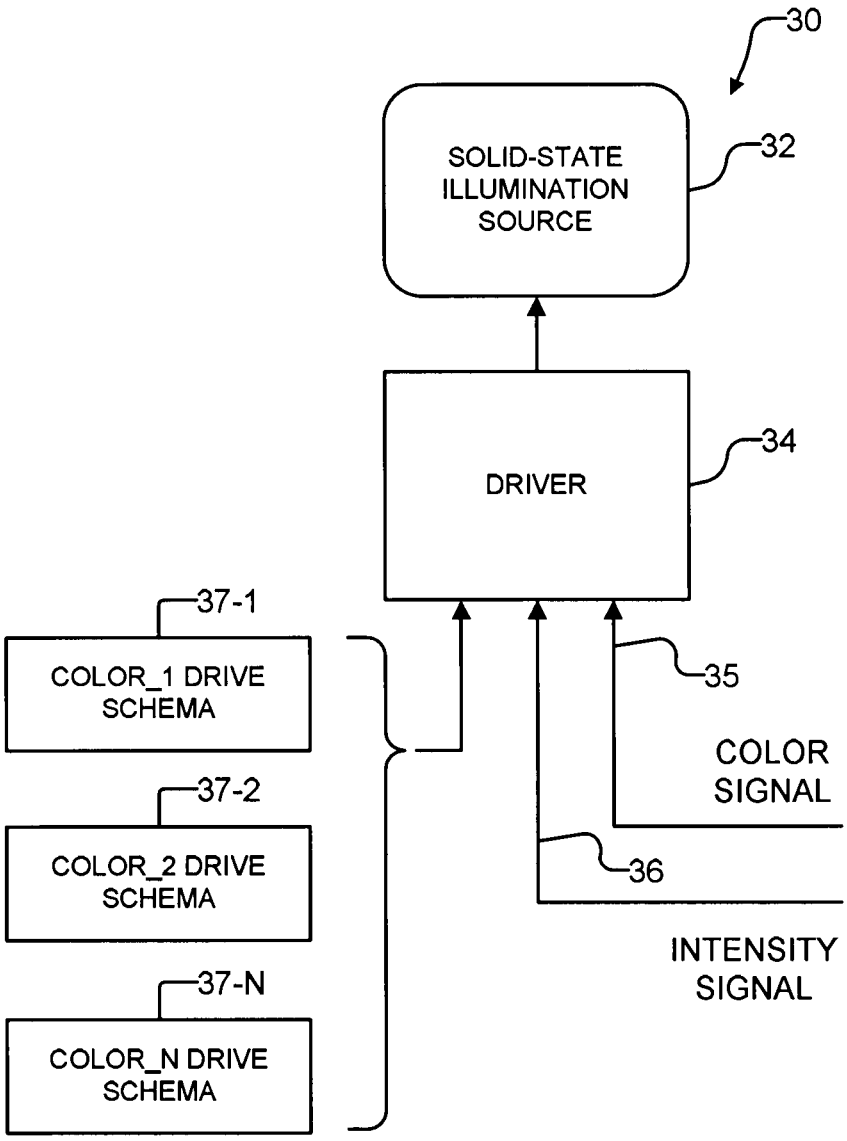
FIG. 4 is a block diagram of apparatus according to an embodiment of the invention which permits adjustment of the chromaticity of light emitted by a solid-state illumination source in response to a color signal.

FIG. 4 shows apparatus 30 according to another embodiment. Apparatus 30 includes a solid-state illumination source 32 driven by a driver 34. Driver 34 accepts both a color signal 35 and an intensity signal 36. Color signal 35 specifies a desired chromaticity for the light emitted by solid-state illumination source 32 and intensity signal 36 indicates a desired intensity for the light emitted by solid-state illumination source 32. Driver 34 has access to a number of alternative driving schema. Color_1 driving schema 37-1 can be applied to solid-state illumination source 32 to cause solid-state illumination source 32 to emit light having a first chromaticity. Color_2 driving schema 37-2 can be used to drive solid-state illumination source 32 to emit light having a second chromaticity. Color_N driving schema 37-N may be applied to drive solid-state illumination source 32 to emit light having a different chromaticity. Any number of different driving schemas may be provided. The driving schemas may be stored in a data store accessible to driver 34. Color signal 35 causes selection of a driving schema 37 which is applied by driver 34 to drive solid-state illumination source 32 to emit light having the desired chromaticity.

Figure 4A:
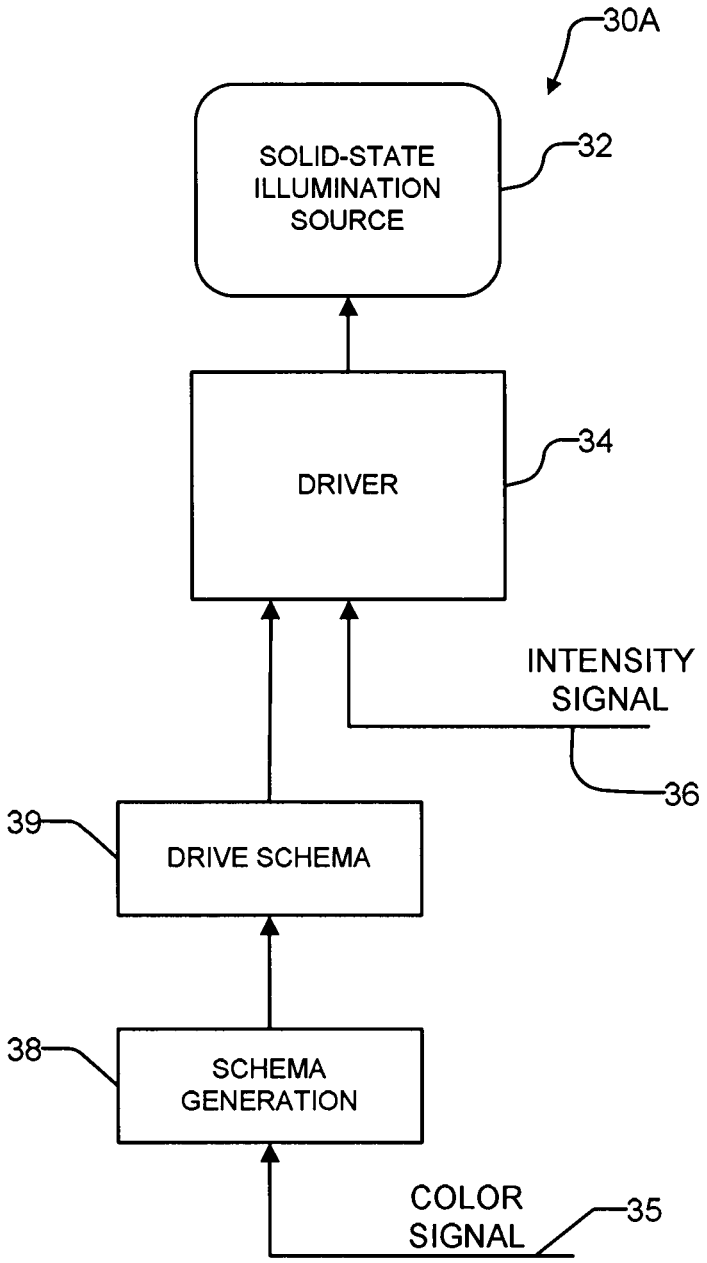
FIG. 4A is a block diagram of apparatus according to another embodiment.

In apparatus 30A according to an alternative embodiment as shown for example in FIG. 4A, color signal 35 is an input to a schema generation circuit 38. In response to color signal 35, schema generation circuit 38 generates parameters that define a driving schema 39. Circuit 38 may, for example, comprise a programmed data processor which computes appropriate parameters to define a driving schema by applying a function of color signal 35 to general parameters relating to solid-state illumination source 32. Drive schema 39 may comprise information stored in a memory such as a data store, registers accessible to driver 34, or the like, for example.

As in previous embodiments, driver 34 may drive multiple different LEDs or other solid-state illumination sources 32. Color signals may be provided separately for each solid-state illumination source 32 or a single color signal may be provided for all of, or sets of, solid-state illumination sources 32. The embodiments of FIG. 4 or 4A may be applied, for example, in cases where it is desired to provide user control or automatic control over the chromaticity of light emitted by a set of solid-state illumination sources.

Figure 5:
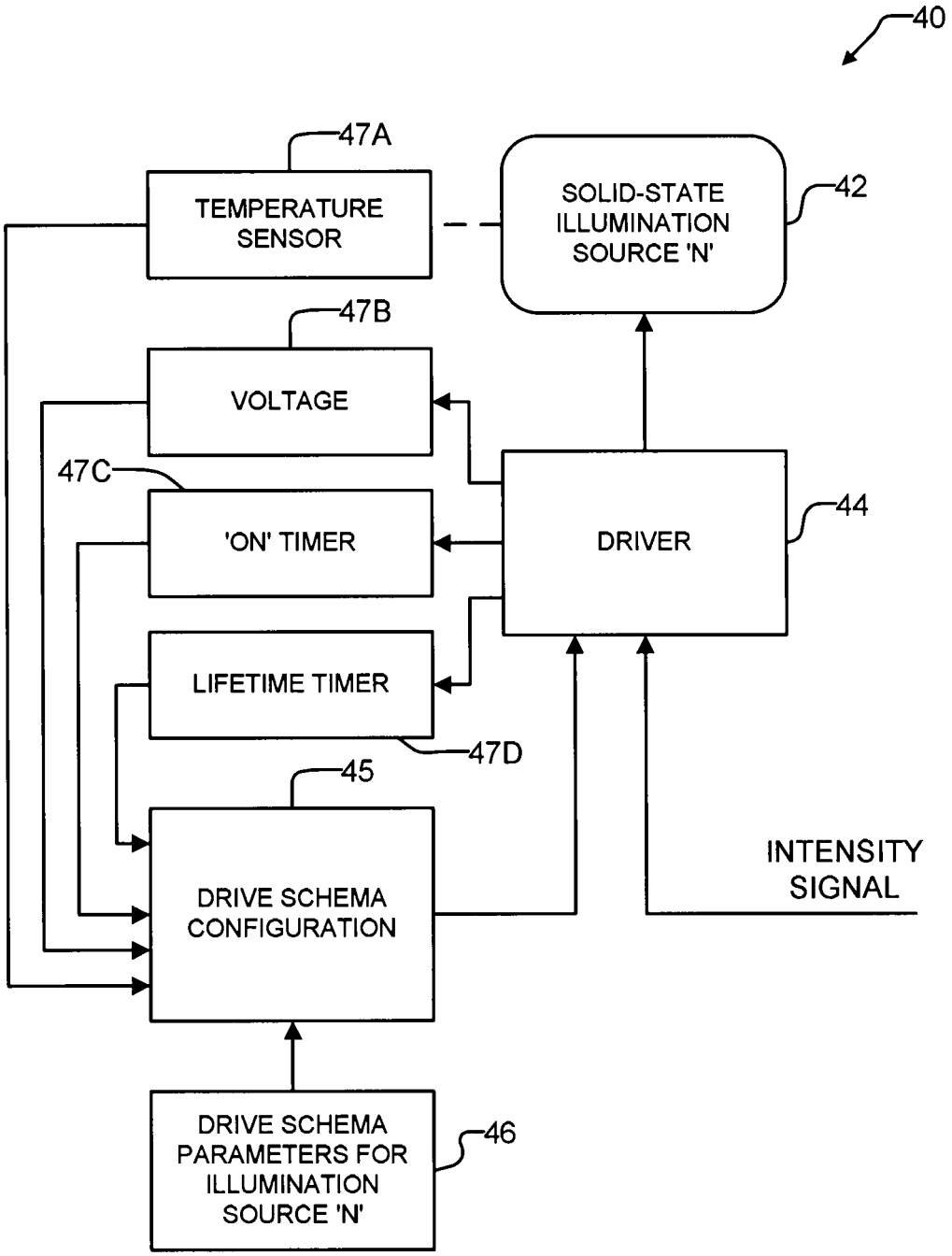
FIG. 5 is a block diagram of apparatus according to an embodiment of the invention which adjusts a driving signal to a solid-state illumination source to maintain a desired chromaticity in response to one or more inputs.

FIG. 5 shows apparatus 40 according to another embodiment which includes a solid-state illumination source 42. Illumination source 42 is driven by a driver 44 which receives an intensity signal indicating the brightness of light to be emitted by solid-state illumination source 42.

Apparatus 40 includes a number of sensors which detect various conditions affecting the operation of solid-state illumination source 42. It is not necessary that all of the sensors illustrated in FIG. 5 be present. In some embodiments, only one of, or only a subset of the sensors are provided. FIG. 5 shows:

- a temperature sensor 47A which senses a temperature of solid-state illumination source 42 or its surroundings,
- a voltage sensor 47B which measures, directly or indirectly, the voltage drop (forward voltage) across solid-state illumination source 42. Voltage sensor 42 may measure directly the voltage drop across a solid-state illumination source. Voltage sensor 42 may measure the voltage drop indirectly, for example, by comparing a voltage of a test point on a driver circuit (e.g. a driver pin) connected to the solid-state illumination source to a known voltage such as a supply voltage (e.g. VCC) or a ground potential.
- an 'on' timer 47C which monitors a period of elapsed time since solid-state illumination source 42 was switched on, and
- a lifetime timer 47D which monitors a cumulative use time for solid-state illumination source 42.

In some embodiments, lifetime timer 47D integrates a driving current applied to solid-state illumination source 42. In other embodiments, lifetime timer 47D monitors a cumulative 'on time' of solid-state illumination source 42. In other embodiments, lifetime timer 47D monitors a difference between a current date and a date of manufacture of solid-state illumination source 42 (or other reference date).

Outputs from sensors 47A-D are provided to a driving schema configuration system 45. Driving schema configuration system 45 has access to parameters 46 for solid-state illumination source 42. Based on parameters 46 and on sensor signals from one or more sensors 47, driving schema configuration system 45 generates a driving schema 48 to be applied in generating a driving current to drive solid-state illumination source 42.

The embodiment of FIG. 5 may be applied for various purposes. In some embodiments, apparatus 40 compensates for shifts in chromaticity of light emitting diodes (or other solid-state illumination sources) that occur as the light emitting diodes age. Such embodiments may apply signals from a lifetime timer 47D to change the driving schema used to define the driving current applied to solid-state illumination source 42 as the solid-state illumination source 42 ages in such a manner that the chromaticity of solid-state illumination source 42 remains generally constant. Apparatus 40 may be applied to compensate for shifts in chromaticity that may occur as a result of the ambient temperature in which apparatus 40 is operated or as a result of warming that occurs through the use of solid-state illumination source 42 and any surrounding solid-state illumination sources or other equipment. In such embodiments, temperature sensor 47A may sense the temperature and driving schema configuration system 45 may alter the driving schema based upon the temperature measured by temperature sensor 47A to compensate for any shift in chromaticity that arises by way of the change in temperature. As an alternative to having a temperature sensor, solid-state illumination source 42 may itself be used as a temperature sensor by monitoring the relationship between forward voltage across the solid-state illumination source and the current through solid-state illumination source 42.

Figure 6:
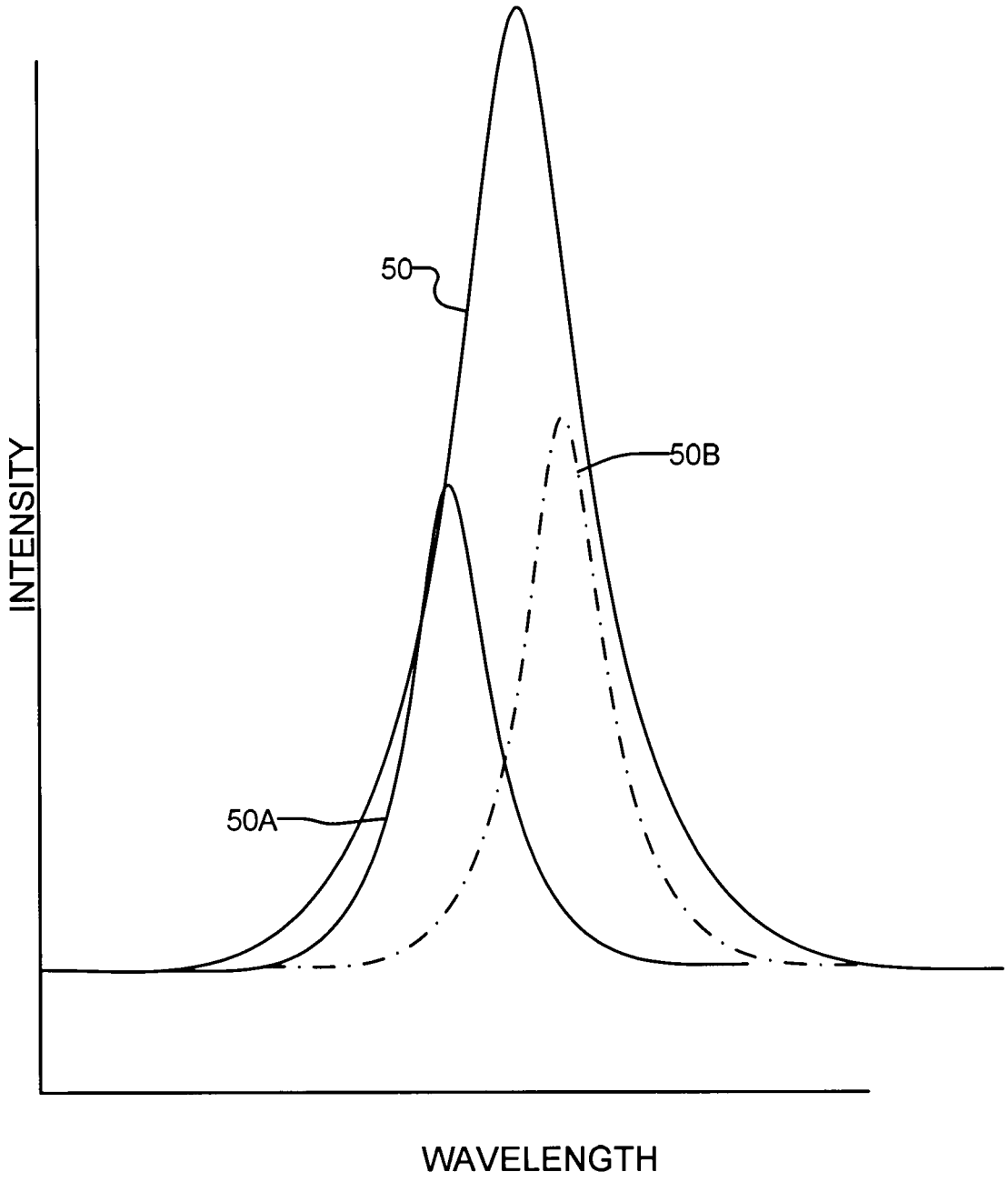
FIG. 6 illustrates light having a spectral composition resulting from the combination of light from two different illumination sources emitting light of different spectral compositions.

As shown in FIG. 6, light having a desired spectral distribution as illustrated by a curve 50 may be generated by mixing light having a first spectral distribution as illustrated by curve 50A with light having a second spectral distribution as illustrated by curve 50B. This technique may be applied in a wide range of contexts. In one context, this technique permits light having a desired spectral composition 50 to be generated by the use of LEDs having shifted spectral compositions 50A and 50B.

Figure 7:
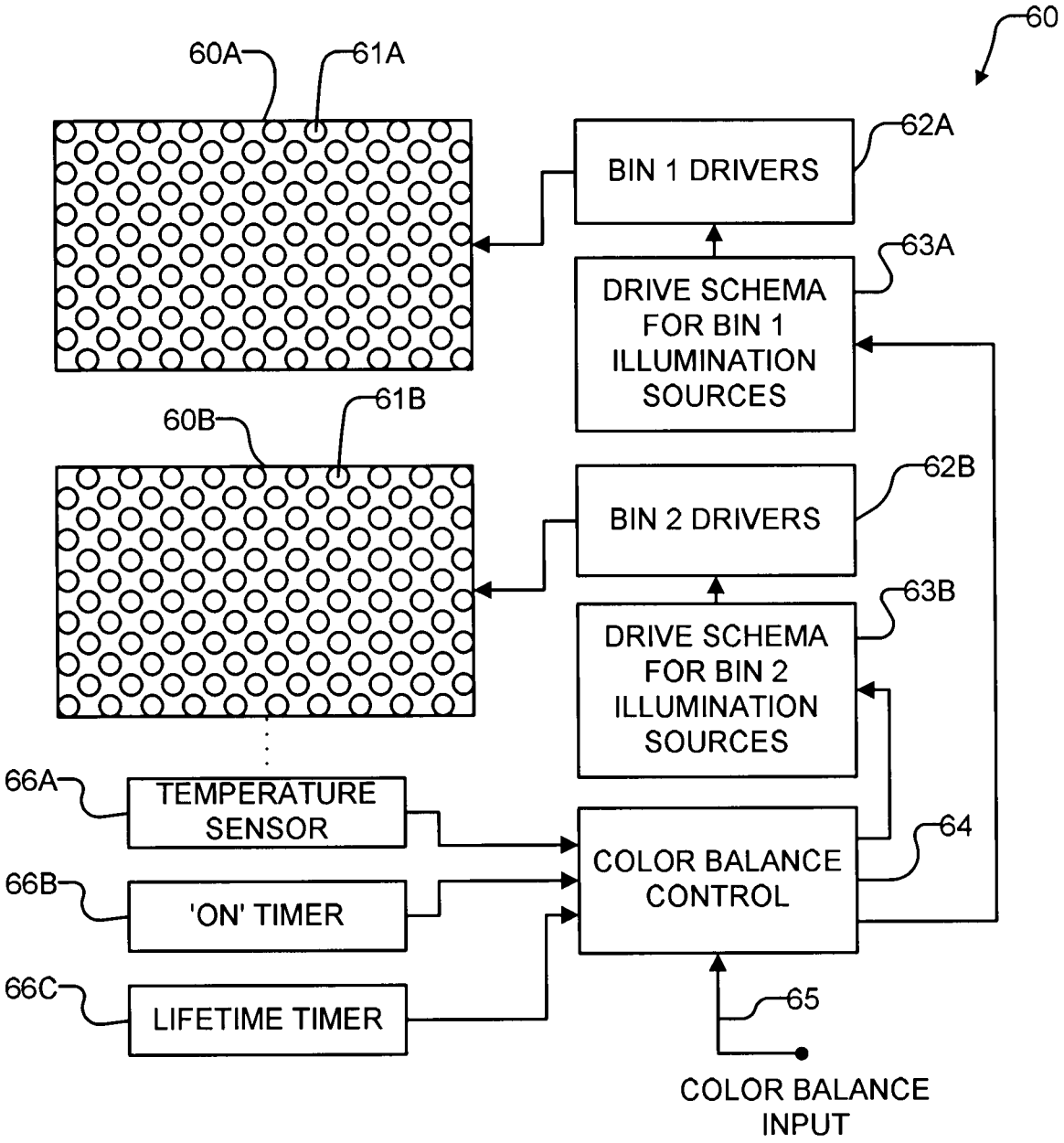
FIG. 7 is a block diagram of apparatus according to an embodiment of the invention which provides two arrays of solid-state illumination sources and permits adjustment of a color balance of light emitted by the illumination sources by varying driving currents and/or driving current waveforms for the illumination sources.

FIG. 7 illustrates apparatus 60 which may operate in a manner as generally indicated by FIG. 6. FIG. 7 includes an array of solid-state illumination sources. The array is divided into sub-arrays 60A and 60B which respectively comprise illumination sources 61A and 61B. Although sub-arrays 60A and 60B are illustrated separately for clarity, the illumination sources of sub-arrays 60A and 60B may be intermixed with one another. Although apparatus 60 includes two sub arrays, there may be three or more such sub-arrays.

Sub-array 60A is driven by "bin 1" drivers 62A and sub-array 60B is driven by "bin 2" drivers 62B. Drivers 62A and 62B may apply the same driving signals to all of the driven illumination sources or may apply individually-determined driving signals to different ones of the illumination sources. Drivers 62A and 62B may individually control the intensity of light emitted by the corresponding illumination sources 61A and 61B or may control light intensity collectively for all of the driven light emitters or subsets thereof.

A color balance control 64 sets a driving schema 63A for bin 1 drivers 62A and a driving schema 63B for bin 2 drivers 62B. Color balance control 64 may be used to:

adjust the spectral composition of light emitted by sub-arrays 60A and 60B by changing the driving schema while leaving the overall brightness of light emitted by the solid-state illumination sources unaltered, adjust the intensity of light emitted by the corresponding solid-state illumination sources without adjusting the spectral composition of that light, or cause shifts in both the brightness and the spectral composition of the emitted light.

Color balance control 64 may make these changes based upon a color balance input 65 in some embodiments.

In some embodiments, illumination sources 61A of sub-array 60A may comprise white LEDs selected from a bin of "yellowish" LEDs. Likewise, illumination sources 61B of sub-array 60B may comprise white LEDs selected from a bin of "blueish" LEDs. Such yellowish and blueish LEDs are typically less expensive than "true" white LEDs, thereby resulting in cost savings in the manufacture of apparatus 60. Drivers 62A and 62B may compensate for differences in the chromaticities of the yellowish and blueish LEDs by applying appropriate driving schemas.

In some embodiments, illumination sources 61A of sub-array 60A and illumination sources 61B of sub-array 60B may all comprise LEDs that nominally emit light of the same color. Illumination sources 61A of sub-array 60A may be selected from a bin of LEDs for which the light is shifted toward longer wavelengths and illumination sources 61B of sub-array 60B may be selected from a bin of LEDs for which the light is shifted toward shorter wavelengths. The light output by apparatus 60 may be controlled as described herein to provide light having a spectral peak at a desired value. Drivers 62A and 62B may compensate for differences in the chromaticities of the LEDs of subarrays 60A and 60B by applying appropriate driving schemas.

In FIG. 7, a number of sensors 66 provide input to color balance control 64. A temperature sensor 66A senses temperatures of solid-state illumination sources 61A and 61B of sub-arrays 60A and 60B. An 'on' timer 66B monitors a time since apparatus 60 was energized. A lifetime timer 66C monitors an age of apparatus 60. Color balance control 64 may adjust driving schemas 63A and 63B in order to compensate for shifts in chromaticity that occur based on changes in temperature and/or the age of solid-state illumination sources 61A and 61B.

While a number of exemplary aspects and embodiments have been discussed above, those of skill in the art will recognize certain modifications, permutations, additions and sub-combinations thereof. For example:

It is not mandatory that each solid-state illumination source have a separate package. In some embodiments, two or more solid-state illumination sources may share a common package.

Features described herein in example embodiments may be combined in different combinations and sub-combinations to provide other embodiments.

It is therefore intended that the following appended claims and claims hereafter introduced are interpreted to include all such modifications, permutations, additions and sub-combinations as are within their true spirit and scope.

What is claimed is:

1. Apparatus for driving a light-emitting diode, the apparatus comprising:

a driving circuit configured to control a driving current in the light-emitting diode according to a driving schema and a control value to cause the light-emitting diode to emit light having a brightness determined by the control value and a chromaticity determined by the driving schema, the driving schema specifying one or more characteristics of the driving current; and, a control circuit configured to alter the driving schema to alter the chromaticity of the light emitted by the light-emitting diode without changing the brightness of the emitted light, wherein altering the driving schema comprises changing from a first driving schema to a second driving schema so as to produce a change in an overall spectral composition of the light emitted by the light-emitting diode.

2. Apparatus according to claim 1 comprising a temperature sensor wherein the control circuit is configured to alter the driving schema based at least in part on a temperature sensed by the temperature sensor.

3. Apparatus according to claim 2 wherein the control circuit is configured to reduce a pulse width specified by the driving schema for the driving current and make a corresponding increase in an amplitude specified by the driving schema for the driving current based at least in part on the temperature sensed by the temperature sensor.

4. Apparatus according to claim 1 comprising a chromaticity sensor wherein the control circuit is configured to alter the driving schema based at least in part on a dominant wavelength sensed by the chromaticity sensor.

5. Apparatus according to claim 1 comprising a lifetime timer configured to maintain a lifetime value representative of an age of the light-emitting diode wherein the control circuit is configured to alter the driving schema based at least in part on the lifetime value.

6. Apparatus according to claim 1 comprising an on timer configured to maintain an on-time value representative of a length of time that the light-emitting diode has been on wherein the control circuit is configured to alter the driving schema based at least in part on the on-time value.

7. Apparatus according to claim 1 comprising a voltage sensor configured to monitor a voltage drop across the light-emitting diode wherein the control circuit is configured to alter the driving schema based at least in part on a voltage drop measured by the voltage sensor.

8. Apparatus according to claim 1 comprising a user control configured to provide a user-input signal indicating a user input wherein the control circuit is configured to alter the driving schema based at least in part on the user-input signal.

9. Apparatus according to claim 1 comprising a memory wherein the driving schema comprises one or more parameters stored in the memory.

10. Apparatus according to claim 1 comprising a plurality of predetermined driving schemas wherein altering the driving schema comprises switching from a first one of the plurality of predetermined driving schemas to a second one of the plurality of predetermined driving schemas.

11. Apparatus according to claim 1 wherein the driving circuit is configured to deliver the driving current in pulses and the control circuit is configured to alter two or more of an amplitude, pulse width and frequency of the pulses without changing the brightness.

12. Apparatus according to claim 1 wherein the control circuit is configured to alter a waveform specified for the driving current and the driving circuit is configured to control the driving current to have the specified waveform.

13. Apparatus according to claim 1 configured to drive a plurality of light-emitting diodes and to apply to each of the light-emitting diodes a driving current according to a corresponding one of a plurality of driving schemas.

14. Apparatus according to claim 13 configured to provide individual control of brightness of each of the plurality of light-emitting diodes.

15. Apparatus according to claim 13 wherein the driving circuit comprises an input for receiving a plurality of control values, each of the plurality of control values corresponding to one of the plurality of light-emitting diodes wherein the driving circuit is configured to control the driving current in each of the plurality of light-emitting diodes according to the corresponding driving schema and the corresponding control value to cause the light-emitting diode to emit light having a brightness determined by the corresponding control value and a chromaticity determined by the driving schema.

16. Apparatus according to claim 1 wherein the light-emitting diode constitutes a first light-emitting diode, the driving circuit constitutes a first driving circuit, the apparatus comprises a second light-emitting diode driven by a second driving circuit, and the apparatus comprises a color balance control configured to alter a spectral composition of light emitted by the first and second light-emitting diodes by altering the driving schema.

17. Apparatus according to claim 16 wherein the first light-emitting diode is one of a first plurality of light-emitting diodes driven by the first driving circuit and the second light-emitting diode is one of a second plurality of light-emitting diodes driven by the second driving circuit.

18. A display comprising:

a plurality of light-emitting diodes;

a driving circuit configured to control a driving current in each of the light-emitting diodes according to a corresponding driving schema, a corresponding control value to cause the light-emitting diode to emit light having a brightness determined by the control value and a chromaticity determined by the corresponding driving schema; and a control circuit configured to alter the driving schema corresponding to one or more of the light-emitting diodes to alter chromaticity of the light emitted by the one or more light-emitting diodes without changing the brightnesses of the light emitted by the one or more of the light-emitting diodes, wherein altering the driving schema comprises changing from a first driving schema to a second driving schema so as to produce a change in an overall spectral composition of the light emitted by the one or more light-emitting diodes.

19. A display according to claim 18 wherein the light-emitting diodes are arranged in a two-dimensional array.

20. A display according to claim 19 wherein the plurality of light-emitting diodes emit light having a first range of spectral characteristics if driven according to the same driving schema and the corresponding driving schemas are selected to cause light emitted by the plurality of light-emitting diodes to have a range of spectral characteristics smaller than the first range.

21. A method for controlling a light-emitting diode, the method comprising controlling a driving current in the light-emitting diode according to a driving schema and a control value to cause the light-emitting diode to emit light having a brightness determined by the control value and a chromaticity determined by the driving schema, the driving schema specifying one or more characteristics of the driving current; and, altering the driving schema to alter the chromaticity of the emitted light while maintaining the brightness of the emitted light substantially unchanged, wherein altering the driving schema comprises changing from a first driving schema to a second driving schema so as to produce a change in an overall spectral composition of the light emitted by the light-emitting diode.

22. A method according to claim 21 wherein altering the driving schema comprises changing a waveform specified for a driving current.

23. A method according to claim 22 wherein altering the driving schema comprises changing an amplitude of a driving current for the light-emitting diode.

24. A method according to claim 22 wherein changing the waveform comprises altering a width of pulses in the waveform.

25. A LED driver unit for driving a plurality of light-emitting diodes, the driver unit comprising:

a plurality of driving circuits each having an input for receiving a control value and an output connectible to a light-emitting diode to be driven, for each of the driving circuits an independently-variable stored driving schema specifying one or more characteristics of the driving current;

wherein the driver circuits are each configured to control a driving current in the light-emitting diode according to the corresponding driving schema and the corresponding control value to cause the light-emitting diode to emit light having a brightness determined by the control value and a chromaticity determined by the driving schema and the driving circuit is configured to alter the driving schema for one or more of the driver circuits to cause a change in the chromaticity of light emitted by the corresponding light-emitting diode to be driven without affecting the brightness determined by the control value, so as to produce a change in an overall spectral composition of the light emitted by the corresponding light-emitting diode to be driven.

26. A LED driver unit according to claim 25 provided in an integrated circuit chip.

* * * * *